United States Patent [19]

Kannwischer

[11] Patent Number: 4,785,514

[45] Date of Patent: Nov. 22, 1988

[54] OSCILLATING ROLLER MOUNTED ON A FIXED SHAFT

[75] Inventor: Kurt R. Kannwischer, Lithonia, Ga.

[73] Assignee: HH&L Co., Stone Mountain, Ga.

[21] Appl. No.: 106,177

[22] Filed: Oct. 7, 1987

Related U.S. Application Data

[63] Continuation-in-part of Ser. No. 43,164, Apr. 27, 1987.

[51] Int. Cl.[4] ..... B21B 13/02

[52] U.S. Cl. ..... 29/116.1; 29/130; 101/348; 101/DIG. 14; 226/19; 226/194

[58] Field of Search ..... 29/116 R, 116 AD, 130; 101/148, 348, 349, DIG. 14; 118/DIG. 15; 139/304; 226/19, 190, 194; 242/76

[56] References Cited

U.S. PATENT DOCUMENTS

| | | | |
|---|---|---|---|
| 2,152,561 | 3/1939 | Nigra | 29/116 R |
| 2,356,010 | 8/1944 | Seymour | 29/116 R |
| 3,625,148 | 12/1971 | Muselik et al. | 101/348 |
| 3,743,152 | 7/1973 | Greeves | 226/19 |
| 4,546,701 | 10/1985 | Junghans | 101/349 |
| 4,718,344 | 1/1988 | Lemaster | 101/348 X |

FOREIGN PATENT DOCUMENTS

| | | | |
|---|---|---|---|
| 2931141 | 2/1981 | Fed. Rep. of Germany | 101/348 |
| 348088 | 9/1960 | Switzerland | 29/116 R |
| 2171358 | 8/1986 | United Kingdom | 101/DIG. 14 |

*Primary Examiner*—P. W. Echols
*Assistant Examiner*—Andrew E. Rawlins
*Attorney, Agent, or Firm*—Patrick F. Henry, Sr.

[57] ABSTRACT

A fixed, non-rotating shaft supports a resilient roller for rotation and oscillation by means of bearing assemblies adjacent opposite ends of the roller. Each bearing assembly comprises a rotary bearing mounted inside the respective end of the roller and a reciprocating bearing assembly mounted in a respective keyway on the shaft so that the roller rotates about the fixed shaft but oscillates and reciprocates for a limited distance in opposite directions. The rotary bearing has the reciprocating bearing mounted therein in a housing as a subassembly.

5 Claims, 1 Drawing Sheet

OSCILLATING ROLLER MOUNTED ON A FIXED SHAFT

This application is a continuation-in-part of my application Ser. No. 07/043,164, filed 04/27/87, in which there is disclosed the basic arrangement of a roller that reciprocates on bearings on a shaft for a limited amount in opposite directions.

A roller, such as an inking roller used on a printing press, is mounted on a fixed shaft for rotation thereon, as well as reciprocation in opposite directions on the shaft for use, for example, in the graphic arts, such as on a lithographic press, in the form position in an ink train running against the plate.

The present arrangement provides a composite bearing assembly providing both rotation of the roller as well as reciprocation and oscillation of the roller on a fixed shaft. According to the present arrangement the composite bearing assembly includes a bearing for both rotation and reciprocation and other means for mounting the resilient covered roller on the shaft.

As stated in my previously mentioned application, there are various reasons for using a roller which reciprocates for a limited amount in opposite directions as well as constantly rotating during the reciprocation. Such an arrangement is used in the printing field to help spread the ink, remove unwanted accumulation and reduce condition known as ghosting.

The purpose of the present arrangement is to provide a way of mounting the roller for reciprocation and rotation on a fixed shaft for those instances on printing machines or other machines where it is not desirable or possible to use a rotating shaft that necessarily must be mounted in some sort of bearings to provide the rotation. In the present arrangement the supporting shaft may be mounted in any fashion in fixed position for non-rotation and the roller is mounted on bearings which provide both rotation and reciprocation on the shaft.

An object of this invention is to provide a reciprocating roller assembly which includes a composite bearing assembly for both oscillation and rotation.

An advantage of the present invention is found in the use of the composite bearing assembly which is inserted into opposite ends of the roller.

Other and further objects and advantages of this invention will become apparent upon reading the description of the preferred embodiment taken in conjunction with the accompanying drawings, in which.

DESCRIPTION OF A PREFERRED EMBODIMENT

Figure 1:
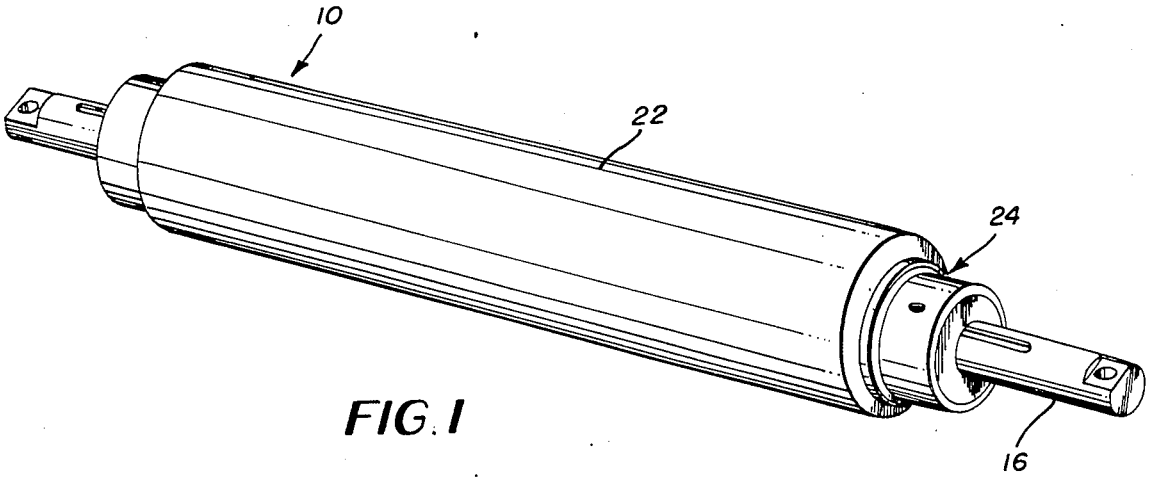
FIG. 1 is a perspective view of the roller assembled with the bearings on a shaft which is non-rotatable.
Figure 2:
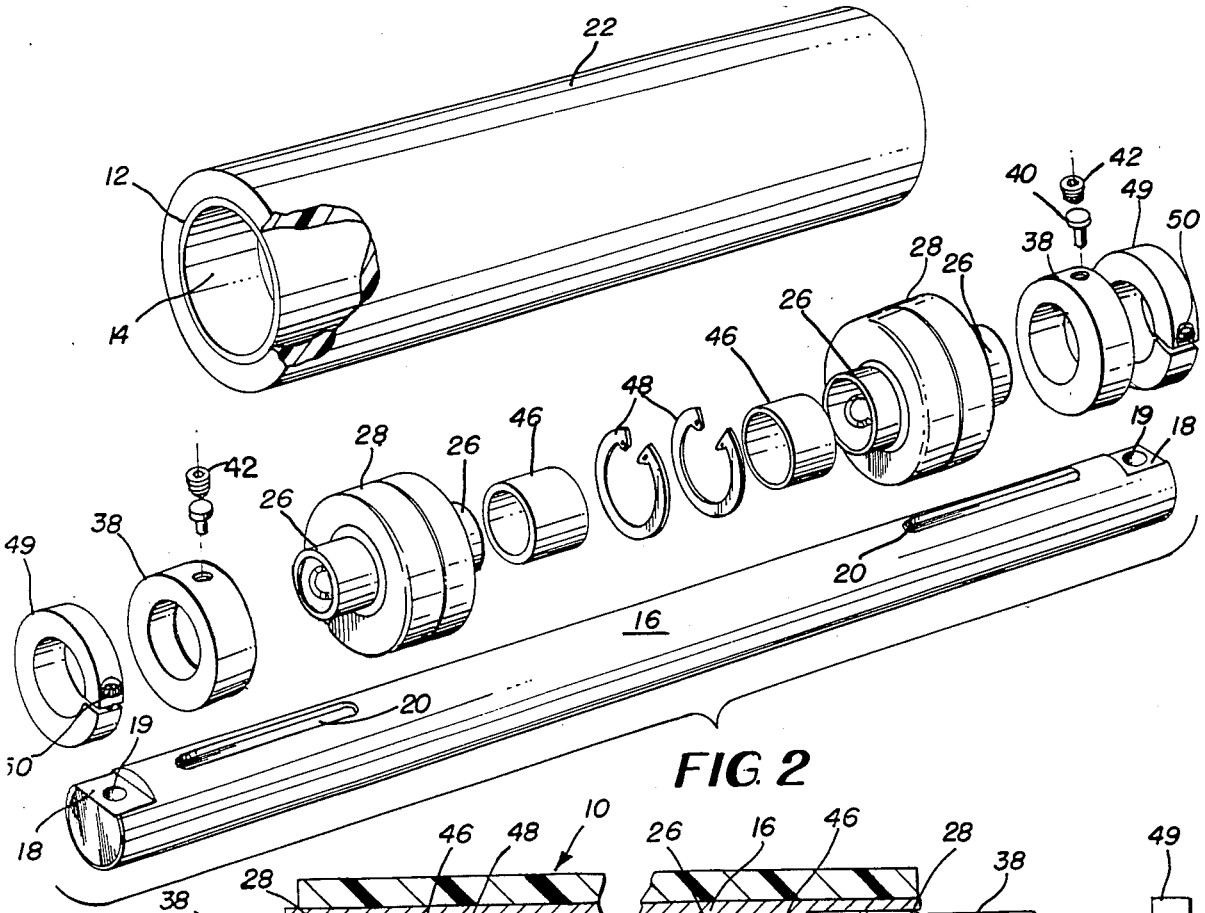
FIG. 2 is a disassembled assembly view of the roller in FIG. 1.

The oscillating roller 10 comprises an elongated cylindrical metal sleeve or core 12 having a longitudinal bore or central opening 14 in which is mounted a steel shaft 16 having a flat end 18 on each end with a hole 19 and a key way 20 on each end. Shaft 16 may be fixed against rotation by any other means.

Sleeve 12 is tightly covered by a cylindrical cover 22 constructed from an elastomer, rubber compound or other suitable material. Cover 22 may be provided with a tacky surface, such as found in a "Bingham Hickye Pick-up", Samuel Bingham Co., 4880 Samuel Bingham Court, College Park, Ga. 30349, or sprayed with a tacky surface such as that provided by the product "Tackit" (trademark), sold by Zim Chemical Co., P.O. Box 13641, Station K, Atlanta, Ga. 30324.

Roller 10 is supported on shaft 16 for both rotation and oscillation by means of composite bearing assemblies 24 comprising an internal inner bearing 26, such as those known as "Ball Bushing" (trademark) produced by Thompson Industries, Inc. of Manhesset, NY 10030, each of which is slip-fitted into an outer, needle bearing 28 which is press-fitted tightly into the respective end 14 of roller 10 so that the outer housing of bearing 28 is fixed with respect to the sleeve 12 and the outer housing of bearing 26 is fixed from rotation in bearing 28. Bearing 26, as described in my previous application, has a series of circumferentially arranged ball bearings 32 which support longitudinal movement of the entire bearing assembly on shaft 16 while permitting roller 10 to rotate about bearing 26. Bearing 26 is a lateral bearing prevented from rotation by means of the keyway 20 and a collar 38 which is press-fitted over the end of the bearing 26 and in which is a dog or pin member 40 projecting into the keyway 20 and held in place by an Allen screw 42. Collar 38 is provided with a rubber seal 44. A metal sleeve 46 fits over the inner bearing 26 to hold the needle bearing 28 in place together with a snap ring 48 and collar 38. A bearing No. NK 113-5911 may be obtained from INA Bearings, Bensalem, Pa. 19020, to be used as bearing 28.

Slip collar 49 on each end of shaft 16 is split and removably held together by means of a screw 50 to limit the sideways (transverse) movement of roller 10. Collars 49 are each adjustable on shaft 16.

Figure 3:
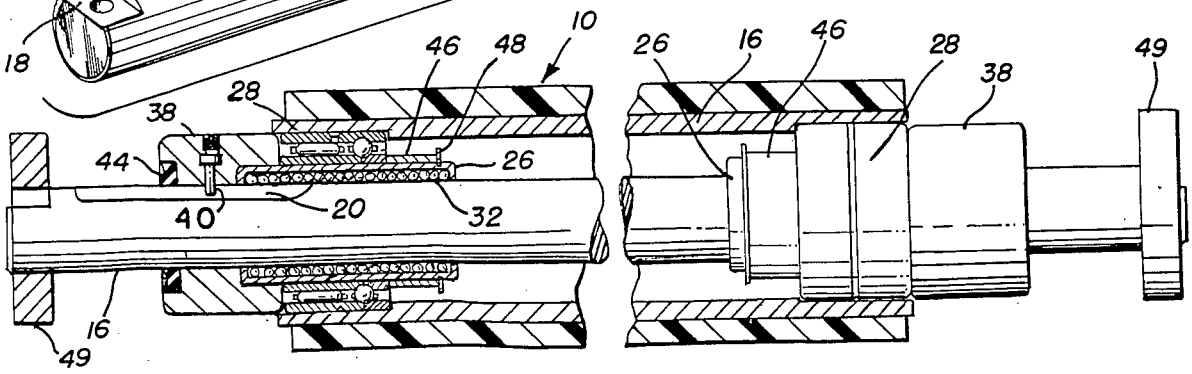
FIG. 3 is a longitudinal, medial cross-sectional view through the roller shown in FIG. 1.

Bearing asseembly 24 is a sub-assembly of bearings 26 and 28 in the housing of 26 and ma be inserted into the metal sleeve 12 as shown in FIG. 3.

In the operation of the device as described previously, shaft 16 is fixedly mounted in place for non-rotation and when motion is imparted to the surface of the cover 22 the roller 10 will rotate on the outer needle bearing 28 while reacting and responding to the rotary motion so that the roller 10 reciprocates and oscillates longitudinally of the shaft 16 in a back and forth motion while pin 48 rides in the respective keyway 20 to one end thereof and then back to the other end and so on in repetition. The inner sleeve bearing 26 cannot rotate because of the pin 40 and the collar 38, but the roller sleeve 12 together with the cover 22 rotates freely on the outer bearing 28.

While I have shown and described a particular embodiment of my invention together with a sugqested mode of operation, this is for purpose of illustration of a preferred embodiment and does not constitute any limitation since various alterations, changes, deviations and departures which may be made in the preferred embodiment without avoiding the scope of this invention as determined only by a proper interpretation of the claims.

What is claimed is:

1. In a roller assembly:

a roller, a shaft mounted in and through said roller and being fixed against rotation, and bearing means supporting said roller for rotation and reciprocation on said shaft, said bearing means comprising an inner bearing for longitudinal motion on said shaft so that said roller reciprocates and oscillates during motion said bearing means comprising and outer bearing which supports said roller for rotation, said outer bearing being assembled with and mounted on said inner bearing, said shaft having a keyway adjacent each end thereof and said inner bearing having a portion thereof mounted for movement in said keyway.

2. The device claimed in claim 1 wherein said inner bearing is a roller bearing having a plurality of circumferentially spaced rows of ball bearings.

3. The device claimed in claim 1 wherein there is a collar attached to said inner bearing and said collar has a pin therein projecting into said keyway.

4. The device claimed in claim 3 wherein there is a thrust washer mounted on said inner bearing between said inner bearing and said collar.

5. The device claimed in claim 4 wherein there is a retainer mounted on said shaft and next to said inner bearing.

* * * * *